United States Patent [19]

Kong

[11] 4,156,489

[45] May 29, 1979

[54] CAP AND CONTAINER IN COMBINATION WITH A SAFETY LOCKING MEANS

[76] Inventor: Cheung T. Kong, 269 S. Lafayette Park Pl., Apt. 304, Los Angeles, Calif. 90057

[21] Appl. No.: 924,612

[22] Filed: Jul. 14, 1978

[51] Int. Cl.[2] ..... B65D 55/02; B65D 85/56; A61J 1/00

[52] U.S. Cl. ..... 215/214; 215/222; 215/223

[58] Field of Search ..... 215/214, 222, 217, 223

[56] References Cited

U.S. PATENT DOCUMENTS

| | | | |
|---|---|---|---|
| 3,749,270 | 7/1973 | Affleck | 215/222 |
| 3,844,407 | 10/1974 | Buie | 215/222 X |
| 3,896,959 | 7/1975 | Roy | 215/222 |
| 4,020,965 | 5/1977 | Northup | 215/214 X |

*Primary Examiner*—George T. Hall

*Attorney, Agent, or Firm*—Christie, Parker & Hale

[57] ABSTRACT

A cap and container are incorporated in a combination having apparatus to provide a convertible feature such that a selection can be made between, on the one hand, a precautionary arrangement to prevent children from obtaining access into the container and, on the other hand, an easy open arrangement.

6 Claims, 3 Drawing Figures

CAP AND CONTAINER IN COMBINATION WITH A SAFETY LOCKING MEANS

BACKGROUND OF THE INVENTION

This invention relates to a cap and container combination for containing medicine and the like.

In U.S. Pat. No. 4,095,718, the entire disclosure of which is hereby incorporated by reference, there is disclosed and claimed a cap adapted to cooperate with a conventional container to provide a precautionary arrangement and to be converted to provide an alternative easy open arrangement.

Such a precautionary arrangement is characterized by a locking of the cap on the container such that a complex manipulation is required to remove the cap from the container. By making it necessary to perform such a complex manipulation in order to remove the cap from the container, an advantage arises with respect to preventing children from gaining access to the medicine and the like in the container. Although such a precautionary arrangement is advantageous in circumstances where a need for safety exists, it constitutes a nuisance in other circumstances. For example, many elderly people never have small children in their homes. Moreover, such older people may be lacking in manual dexterity and accordingly find it difficult and sometimes impossible to unlock the cap from the container so that they can take the medicine they need. Separately, pharmacists who dispense the medicine fill many containers during a working day and are continually removing and replacing the caps. Owing to the complex manipulations involved in locking and unlocking, done repeatedly, the pharmacists suffer discomfort and irritation to their hands.

SUMMARY OF THE INVENTION

The present invention is embodied in apparatus incorporated in a combination for containing medicine and the like. The combination includes a container having a mouth defining a circular access opening, and a container cap having a cover wall and a side wall projecting from the cover wall to define a container-receiving recess. The apparatus releasably secures the cap to the container so as convertibly to define alternative precautionary and easy open arrangements.

In an embodiment of the apparatus, there is provided, firstly, closure means for closing the access opening. Preferably, the closure means provides for plugging the access opening. Guide means are provided for guiding relative motion between the cap and the closure means such that the cap can be pushed to translate the cap relative to the closure means and such that the cap can be rotated to cause the closure means to rotate. The apparatus further comprises first and second locking means cooperating between the cap and the container for use in the precautionary arrangement. The first locking means includes a locking rim having a notch and having a depending leg adjacent the notch. The second locking means includes tab means for passing through the notch. Threaded securing means cooperate between the container and the closure means in both the precautionary arrangement and the easy open arrangement to provide for twisting the cap onto and off of the container. Preferably, the threaded securing means includes threads on an interior portion of the container and threads on an exterior portion of the closure means so that the closure means can be threaded into and plug the container. The apparatus further includes resilient means, preferably attached to the closure means, to occupy space between the closure means and the cover wall so that, in the course of a conversion operation changing from the easy open to the precautionary arrangement, a resilient reaction force must be overcome while pushing the cap to cause the tab means to slide through the notch past the depending leg so that further twisting of the cap locks the cap on the container.

DETAILED DESCRIPTION

Figure 1:
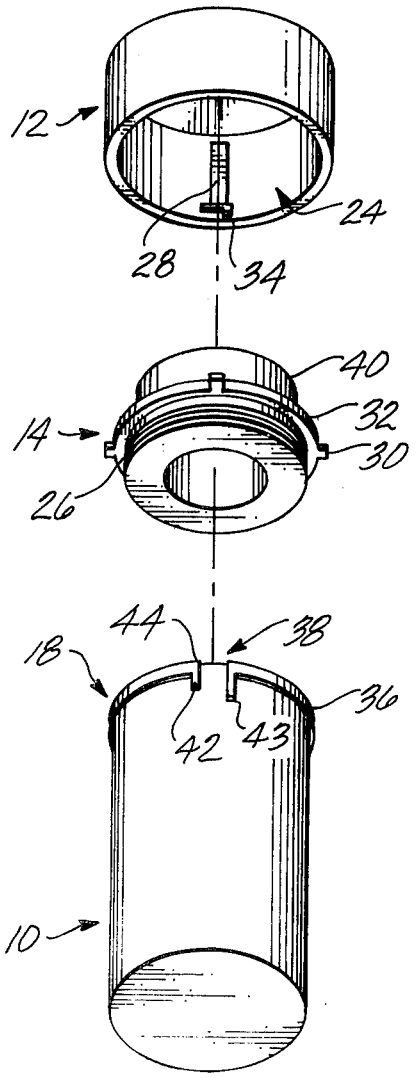
FIG. 1 is an exploded, perspective view of a combination embodying apparatus according to a presently preferred embodiment of the present invention.

With reference to the drawings, there will be described apparatus according to a presently preferred embodiment of the present invention. In accordance with the presently preferred embodiment, there are provided a container 10, a cap 12, and a device 14. Container 10 has a mouth 16 defining a circular access opening 18. Cap 12 has a cover wall 20 and a side wall 22 projecting from the cover wall to define a container-receiving recess 24.

Device 14 includes closure means for closing access opening 18. In the illustrated embodiment, the closure means has the form of an externally threaded plug portion 26. The threads on plug portion 26 cooperate with threads on an interior portion 27 of the container.

Guide means are provided for guiding relative motion between the cap and the closure means such that the cap can be pushed to translate the cap relative to the closure means and such that the cap can be rotated to cause the closure means to rotate. The guide means preferably includes four 90° spaced apart axially extending slots 28 defined in the inside of side wall 22, and four cooperating ears 30 projecting radially from a disk portion 32 of device 14.

First and second locking means cooperate between the cap and the container for use in the precautionary arrangement. In the illustrated embodiment, the first locking means is on the cap and comprises a pair of circumferentially spaced apart tabs 34, each preferably L-shaped as shown, and the second locking means comprises a notched rim 36 on the container surrounding the access opening. In the illustrated embodiment, notched rim 36 has two circumferentially spaced apart notches 38. Each of the tabs 34 projects into recess 24 from an area between one of the slots 28 and the bottom of side wall 22. The illustrated embodiment further includes resilient means for occupying space between the closure means and cover wall 20. In the illustrated embodiment, the resilient means has the form of a spongy member 40 adhesively secured to disk portion 32.

A particularly advantageous feature of the presently preferred embodiment arises from the provision of a relatively short depending leg 42 adjacent to notch 38. In the illustrated embodiment there is also provided a relatively long depending leg 43 on the side of notch 38 opposite from the depending leg 42.

Figure 2:
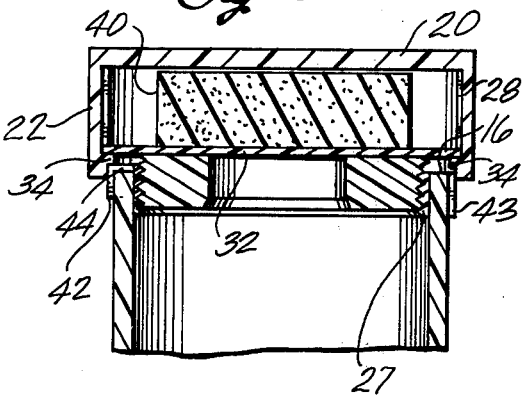
FIG. 2 is a fragmentary cross-sectional view showing an easy open arrangement of the combination of FIG. 1.

FIG. 2 illustrates circumstances in which cap 12 is secured to container 10 in the easy open arrangement. In this arangement, the cap can be separated from the container simply by twisting it off. The manual rotation of the cap is of course coupled to the closure means because of the engagement of ears 30 in the slots 28.

Figure 3:
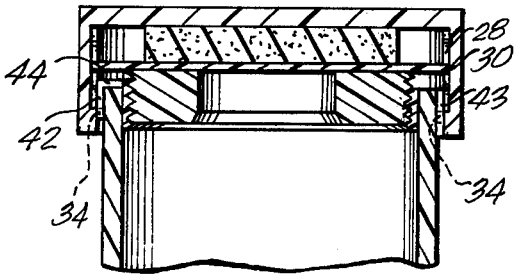
FIG. 3 is a fragmentary cross-sectional view showing a precautionary arrangement of the combination of FIG. 1.

Conversion to the precautionary arrangement (FIG. 3) is effected as follows. First, the cap is twisted onto the container such that tabs 34 are brought into angular aligment with notches 38. Preferably, opposed portions of mouth 16 each taper upwardly to define a stop 44 that the lower portion of the corresponding L-shaped tab tab 34 butts into when such angular alignment is achieved. Now, by manually pushing the cap downwardly toward the container, the cap translates relative to device 14 and each tab 34 slides through the corresponding notch 38, clears depending leg 42, so that further twisting of cap 12 locks the cap onto the container. During this conversion operation, the resilient means acts against cover wall 20 to provide a resilient reaction force that must be overcome while pushing the cap to cause the tabs to slide through the notches past the depending legs.

Further, after the locking operation is completed, and the manual pushing force is discontinued, the resilient means biases the cap upwardly. Thus, if a child were to try to twist the locked cap off, the tabs would, when they are rotated into engagement with the depending legs 42, prevent further twisting of the cap. On the other hand, an adult will realize from this positive stopping action that the tabs are adjacent the notches and will accordingly push the cap down to cause the tabs to clear the depending legs 42, and then will rotate the cap further. The purpose of the relatively long depending legs 43 is to cause another positive stopping action to alert the adult that pushing should be discontinued. Upon such discontinuance of pushing, the resilient means automatically pushes the cap upwardly, thereby translating the tabs through the notches. Now the cap is unlocked and can be separated from the container simply by further twisting.

It will be appreciated by those skilled in the art that various modifications of the specifically described presently preferred embodiment are within the scope of the present invention. For example, the resilient means can alternatively comprise a plurality of leaf springs defined by plastic fingers that slope downwardly from the inside portion of the cover wall. Separately, the securing means can be defined by an externally threaded portion of the container and by an internally threaded portion of an appropriately sized annular portion of the closure means, in which case the locking rim means would be spaced from the container mouth by the externally threaded portion.

What is claimed is:

1. In a combination for containing medicine and the like, which includes a container having a mouth defining a circular access opening, and a container cap having a cover wall and a side wall projecting from the cover wall to define a container-receiving recess, apparatus for releasably securing the cap to the container so as convertibly to define alternative precautionary and easy open arrangements, the apparatus comprising:

closure means for closing the access opening;

guide means for guiding relative motion between the cap and the closure means such that the cap can be pushed to translate relative to the closure means and such that the cap can be rotated to cause the closure means to rotate;

first and second locking means cooperating between the container and the cap for use in the precautionary arrangement, the first locking means including a locking rim having a notch and having a depending leg adjacent the notch, the second locking means including tab means for passing through the notch;

threaded securing means cooperating between the container and the closure means for use in both the precautionary arrangement and the easy open arrangement to provide for twisting the cap onto and off of the container; and resilient means for occupying space between the closure means and the cover wall so that, in the course of a conversion operation changing from the easy open to the precautionary arrangement, a resilient reaction force must be overcome while pushing the cap to cause the tab means to slide through the notch past the depending leg so that further twisting of the cap locks the cap on the container.

2. Apparatus according to claim 1, wherein the closure means comprises plug means for plugging the opening, and wherein the threaded securing means comprises a threaded interior portion of the container and a threaded portion of the plug means.

3. Apparatus according to claim 1, wherein the guide means comprises slot means in the cap and ear means projecting from the closure means for being contained in the slot means.

4. Apparatus according to claim 1, and further comprising an additional depending leg adjacent the side of the notch opposite from the first recited depending leg.

5. Apparatus according to claim 1, wherein the resilient means comprises a spongy pad adhesively secured to the closure means.

6. Apparatus according to claim 1, wherein the tab means comprises an L-shaped tab projecting from the side wall of the cap into the recess.

* * * * *